US010541075B2

(12) United States Patent
Park et al.

(10) Patent No.: US 10,541,075 B2
(45) Date of Patent: Jan. 21, 2020

(54) POWER INDUCTOR

(71) Applicant: MODA-INNOCHIPS CO., LTD., Ansan-Si, Gyeonggi-Do (KR)

(72) Inventors: In Kil Park, Seongnam-Si (KR); Tae Hyung Noh, Siheung-Si (KR); Gyeong Tae Kim, Ansan-Si (KR); Seung Hun Cho, Siheung-Si (KR); Jun Ho Jung, Siheung-Si (KR); Ki Joung Nam, Siheung-Si (KR); Jung Gyu Lee, Seoul (KR)

(73) Assignee: MODA-INNOCHIPS CO., LTD. (KR)

( * ) Notice: Subject to any disclaimer, the term of this patent is extended or adjusted under 35 U.S.C. 154(b) by 0 days.

(21) Appl. No.: 15/502,501

(22) PCT Filed: Jun. 1, 2015

(86) PCT No.: PCT/KR2015/005454
§ 371 (c)(1),
(2) Date: Feb. 7, 2017

(87) PCT Pub. No.: WO2016/021818
PCT Pub. Date: Feb. 11, 2016

(65) Prior Publication Data

US 2017/0236632 A1 Aug. 17, 2017

(30) Foreign Application Priority Data

Aug. 7, 2014 (KR) ..... 10-2014-0101508
Sep. 11, 2014 (KR) ..... 10-2014-0120128
May 4, 2015 (KR) ..... 10-2015-0062601

(51) Int. Cl.
*H01F 5/00* (2006.01)
*H01F 27/22* (2006.01)
(Continued)

(52) U.S. Cl.
CPC ..... *H01F 27/22* (2013.01); *H01F 17/0013* (2013.01); *H01F 17/04* (2013.01);
(Continued)

(58) Field of Classification Search
USPC ..... 336/200
See application file for complete search history.

(56) References Cited

U.S. PATENT DOCUMENTS 5,712,047 A 1/1998 Aso et al.
5,850,682 A 12/1998 Ushiro
(Continued)

FOREIGN PATENT DOCUMENTS

CN 1258373 A 6/2000
CN 1801412 A 7/2006
(Continued)

OTHER PUBLICATIONS

International Search Report and Written Opinion for PCT/KR2015/004135 dated Jun. 30, 2015.
(Continued)

*Primary Examiner* — Ronald Hinson
(74) *Attorney, Agent, or Firm* — Renaissance IP Law Group LLP

(57) ABSTRACT

The present disclosure provides a power inductor, which includes a body, at least one substrate provided inside the body, at least one coil pattern provided on at least one surface of the substrate, and an insulation layer formed between the coil pattern and the body, wherein the insulation layer is formed of parylene.

14 Claims, 9 Drawing Sheets

(51) Int. Cl.

| | |
|---|---|
| ***H01F 27/29*** | (2006.01) |
| ***H01F 17/00*** | (2006.01) |
| ***H01F 17/04*** | (2006.01) |
| ***H01F 27/255*** | (2006.01) |
| ***H01F 27/28*** | (2006.01) |
| ***H01F 27/32*** | (2006.01) |
| ***H01F 27/24*** | (2006.01) |
| ***H01F 41/04*** | (2006.01) |
| ***H01F 41/12*** | (2006.01) |

(52) U.S. Cl.

CPC ..... *H01F 27/24* (2013.01); *H01F 27/255* (2013.01); *H01F 27/2804* (2013.01); *H01F 27/29* (2013.01); *H01F 27/292* (2013.01); *H01F 27/323* (2013.01); *H01F 27/324* (2013.01); *H01F 41/041* (2013.01); *H01F 41/122* (2013.01); *H01F 2017/048* (2013.01); *H01F 2027/2809* (2013.01)

(56) References Cited

U.S. PATENT DOCUMENTS 5,889,445 A 3/1999 Ritter et al.
6,218,925 B1 4/2001 Iwao
6,356,181 B1 3/2002 Kitamura
6,515,556 B1 2/2003 Kato et al.
6,768,410 B1 7/2004 Yazaki et al.
6,998,939 B2 2/2006 Nakayama et al.
7,084,730 B2 8/2006 Kitagawa
7,085,118 B2 8/2006 Inoue et al.
7,408,435 B2 8/2008 Nishikawa et al.
7,497,005 B2 3/2009 Forbes et al.
7,652,554 B2 1/2010 Moriai et al.
7,772,956 B2 8/2010 Toi et al.
8,471,668 B2 6/2013 Hsieh et al.
8,514,539 B2 8/2013 Asakawa et al.
9,263,786 B2 2/2016 Suga et al.
9,406,420 B2 * 8/2016 Ohkubo ..... H01F 5/00
9,490,059 B2 11/2016 Nishio et al.
9,558,890 B2 1/2017 Hattori et al.
9,576,711 B2 2/2017 Yoon et al.
9,647,315 B2 5/2017 Yamatogi et al.
9,899,143 B2 * 2/2018 Kim ..... H01F 17/0013
2002/0033561 A1 3/2002 Kawaguchi
2002/0105406 A1 * 8/2002 Liu ..... H01F 17/0006 336/200
2003/0030994 A1 2/2003 Takaya et al.
2003/0134612 A1 7/2003 Nakayama et al.
2005/0080346 A1 * 4/2005 Gianchandani ..... B23H 9/00 600/486
2007/0080769 A1 4/2007 Thiel et al.
2008/0058652 A1 3/2008 Payne
2009/0137067 A1 5/2009 Forbes et al.
2010/0052838 A1 3/2010 Matsuta et al.
2010/0301981 A1 * 12/2010 Zeng ..... H01F 27/2885 336/105
2011/0007439 A1 1/2011 Asakawa et al.
2011/0178574 A1 * 7/2011 Hardy ..... A61K 33/38 607/50
2011/0291790 A1 12/2011 Okumura et al.
2011/0308072 A1 12/2011 Ahn et al.
2012/0001719 A1 1/2012 Oshima et al.
2012/0146757 A1 6/2012 Tsai et al.
2012/0274432 A1 11/2012 Jeong et al.
2012/0274435 A1 11/2012 Jeong et al.
2013/0038417 A1 2/2013 Kim et al.
2013/0082812 A1 * 4/2013 Yoo ..... H01F 5/003 336/200
2013/0162385 A1 6/2013 Kwak et al.
2013/0169401 A1 7/2013 Lee et al.
2013/0181799 A1 7/2013 Deville et al.
2013/0222101 A1 * 8/2013 Ito ..... H01F 17/04 336/83
2013/0307655 A1 11/2013 Saito et al.
2013/0341758 A1 12/2013 Lee et al.
2014/0001397 A1 1/2014 Park et al.
2014/0022041 A1 1/2014 Park et al.
2014/0022042 A1 1/2014 Park et al.
2014/0028430 A1 1/2014 Lee et al.
2014/0050001 A1 2/2014 Inaba
2014/0077914 A1 3/2014 Ohkubo et al.
2014/0132387 A1 5/2014 Shin
2014/0176284 A1 6/2014 Lee et al.
2014/0184374 A1 7/2014 Park et al.
2014/0218150 A1 8/2014 Cho et al.
2014/0333401 A1 11/2014 Esaki et al.
2014/0333404 A1 * 11/2014 Bae ..... H01F 17/0013 336/192
2014/0347773 A1 * 11/2014 Park ..... H02H 9/005 361/56
2015/0070120 A1 3/2015 Nishio et al.
2015/0087945 A1 * 3/2015 Ziaie ..... A61B 5/05 600/365
2015/0116966 A1 4/2015 Lee et al.
2015/0145616 A1 5/2015 Kim
2015/0145627 A1 5/2015 Sim et al.
2015/0213960 A1 7/2015 Moon et al.
2015/0255206 A1 * 9/2015 Han ..... H01F 27/2804 336/192
2015/0325362 A1 11/2015 Kumura et al.
2015/0340149 A1 * 11/2015 Lee ..... H05K 1/181 174/260
2015/0340150 A1 11/2015 Nakamura et al.
2016/0055964 A1 2/2016 Park et al.
2016/0254086 A1 9/2016 Kim et al.

FOREIGN PATENT DOCUMENTS

CN 101017728 A 8/2007
CN 101152772 A 4/2008
CN 201950034 U 8/2011
CN 102969109 A 3/2013
CN 103035354 A 4/2013
CN 103180919 A 6/2013
CN 103456458 A 12/2013
CN 103515077 A 1/2014
CN 103578708 A 2/2014
CN 103035354 B 11/2016
DE 102005039379 A1 3/2007
JP H0432214 A 2/1992
JP H0714715 A 1/1995
JP 08097045 A 4/1996
JP 08264323 A 10/1996
JP 10241942 A 9/1998
JP 11054336 A 2/1999
JP 11150357 A 6/1999
JP 11260618 A 9/1999
JP 2001057311 A 2/2001
JP 2001338813 A 12/2001
JP 2002231574 A 8/2002
JP 2002305108 A 10/2002
JP 2003059719 A 2/2003
JP 2003282328 A 10/2003
JP 2003297634 A 10/2003
JP 2004056112 A 2/2004
JP 2005038872 A 2/2005
JP 2005183952 A 7/2005
JP 2006147901 A 6/2006
JP 2006157738 A 6/2006
JP 2006273969 A 10/2006
JP 2006286934 A 10/2006
JP 2006310812 A 11/2006
JP 2007012969 A 1/2007
JP 2007067214 A 3/2007
JP 2007194474 A 8/2007
JP 2008072073 A 3/2008
JP 2008147403 A 6/2008
JP 2009049335 A 3/2009
JP 2009117479 A 5/2009
JP 2009302386 A 12/2009
JP 2010010536 A 1/2010

(56) References Cited

FOREIGN PATENT DOCUMENTS

| | | | |
|---|---|---|---|
| JP | 2010080550 | A | 4/2010 |
| JP | 2010153445 | A | 7/2010 |
| JP | 2010209469 | A | 9/2010 |
| JP | 2011018756 | A | 1/2011 |
| JP | 2011504662 | A | 2/2011 |
| JP | 2011077157 | A | 4/2011 |
| JP | 2011258608 | A | 12/2011 |
| JP | 2011530172 | A | 12/2011 |
| JP | 2012089765 | A | 5/2012 |
| JP | 2012109292 | A | 6/2012 |
| JP | 2012156461 | A | 8/2012 |
| JP | 2013042102 | A | 2/2013 |
| JP | 2013098282 | A | 5/2013 |
| JP | 2013521414 | A | 6/2013 |
| JP | 2013239542 | A | 11/2013 |
| JP | 2013251553 | A | 12/2013 |
| JP | 2014011467 | A | 1/2014 |
| JP | 2014013815 | A | 1/2014 |
| JP | 2014013824 | A | 1/2014 |
| JP | 2014503118 | A | 2/2014 |
| JP | 5450565 | B2 | 3/2014 |
| JP | 2014060284 | A | 4/2014 |
| JP | 2014107548 | A | 6/2014 |
| JP | 2014110425 | A | 6/2014 |
| JP | 2014130988 | A | 7/2014 |
| JP | 2016004917 | A | 1/2016 |
| KR | 100479625 | B1 | 3/2005 |
| KR | 20070032259 | A | 3/2007 |
| KR | 20120031754 | A | 4/2012 |
| KR | 20120120819 | A | 11/2012 |
| KR | 20120122589 | A | 11/2012 |
| KR | 20120122590 | A | 11/2012 |
| KR | 20130046108 | A | 5/2013 |
| KR | 101338139 | B1 | 12/2013 |
| KR | 20130135298 | A | 12/2013 |
| KR | 101352631 | B1 | 1/2014 |
| KR | 20140002355 | A | 1/2014 |
| KR | 20140003056 | A | 1/2014 |
| KR | 20140066437 | A | 6/2014 |
| KR | 20140085997 | A | 7/2014 |
| TW | 200915358 | A | 4/2009 |
| TW | 201346951 | A | 11/2013 |
| TW | 201346952 | A | 11/2013 |
| WO | 2013042691 | A1 | 3/2013 |
| WO | 2014087888 | A1 | 6/2014 |

OTHER PUBLICATIONS

International Search Report and Written Opinion for PCT/KR2015/004136 dated Jun. 30, 2015.
International Search Report and Written Opinion for PCT/KR2015/004137 dated Jun. 30, 2015.
International Search Report and Written Opinion for PCT/KR2015/004139 dated Jun. 29, 2015.
International Search Report and Written Opinion for PCT/KR2015/005454 dated Aug. 25, 2015.
International Search Report and Written Opinion for PCT/KR2015/008212 dated Nov. 17, 2015.
Final Office Action for U.S. Appl. No. 15/509,849 dated Sep. 12, 2018.
Extended European Search Report for Application No. 15829073.4 dated May 22, 2018.
Extended European Search Report for Application No. 15839158.1 dated May 24, 2018.
Extended European Search Report for Application No. 15839164.9 dated May 22, 2018.
Extended European Search Report for Application No. 15840080.4 dated Jun. 6, 2018.
Final Office Action for U.S. Appl. No. 15/509,850, dated Dec. 3, 2018.
Final Office Action for U.S. Appl. No. 15/502,500, dated May 31, 2019.
Notice of Allowance for U.S. Appl. No. 15/509,849, dated Oct. 3, 2019.

* cited by examiner

600 : 610, 620, 630, 640, 650, 660

POWER INDUCTOR

BACKGROUND

The present disclosure relates to a power inductor, and more particularly, to a power inductor having a superior inductance characteristic and improved insulation characteristic and thermal stability.

Power inductors are typically provided to power circuits such as DC-DC converters in portable devices. Such power inductors are being widely used instead of typical wire wound-type choke coils as power circuits are operated at higher frequencies and miniaturized. Also, power inductors are being developed in a trend toward being miniaturized and having high current and low resistance, as portable devices become miniaturized and multifunctional.

A power inductor may be manufactured in a laminate form in which ceramic sheets including multiple ferrites or dielectrics with a small dielectric constant are laminated. Here, metal patterns are formed in coil patterns shapes on the ceramic sheets. The coil patterns formed on each of the ceramic sheets are connected by conductive vias formed on each ceramic sheet, and may define an overlapping structure along a vertical direction in which the sheets are laminated. In general, a body constituting such a power inductor has been conventionally manufactured by using a ferrite material including a quaternary system of nickel (Ni)-zinc (Zn)-copper (Cu)-iron (Fe).

However, the ferrite material has a saturation magnetization value lower than that of a metal material, so that high-current characteristics required by modern portable devices may not be realized. Accordingly, a body constituting a power inductor is manufactured by using metal powders, so that saturation magnetization value may be relatively increased in comparison with the case in which the body is manufactured of ferrite materials. However, when the body is manufactured by using metal, a problem of an increase in material loss may occur because loss of eddy current and hysteresis at a high frequency is increased. To reduce such material loss, a structure in which metal powders are insulated therebetween by a polymer is used.

However, the power inductor which has a body manufactured by using metal powders and polymers has a problem in that inductance decreases as temperatures rises. That is, the temperature of a power inductor rises due to the heat generated from a portable device to which the power inductor is applied. Accordingly, a problem in which inductance decreases as the metal powders constituting the body of the power inductor are heated may occur.

Also, in the power inductor, a coil pattern may contact metal powders inside the body. To prevent this, the coil pattern and the body should be insulated from each other.

PRIOR ART DOCUMENTS

KR Patent Publication No. 2007-0032259

SUMMARY

The present disclosure provides a power inductor, in which temperature stability is improved through discharging heat in a body, such that a decrease in inductance may be prevented.

The present disclosure also provides a power inductor capable of improving insulation characteristics between a coil pattern and a body.

The present disclosure also provides a power inductor capable of improving capacity and magnetic permeability.

In accordance with an exemplary embodiment, a power inductor includes a body, at least one substrate provided inside the body, at least one coil pattern provided on at least one surface of the substrate, and an insulation layer formed between the coil pattern and the body, wherein the insulation layer is formed of parylene.

The body may include a metal powder, a polymer, and a heat conducting filler.

The metal powder may include a metal alloy powder containing iron.

The metal powder may have a surface coated with at least one of a ferrite material and an insulator.

The insulator may be coated with parylene in a thickness of approximately 1 um to approximately 10 um.

The heat conducting filler may include one or more selected from the group consisting of MgO, AlN, and a carbon based material.

The heat conducting filler may be included in an amount of approximately 0.5 wt % to approximately 3 wt % with respect to 100 wt % of the metal powder, and have a size of approximately 0.5 um to approximately 100 um.

The substrate may be formed of a copper clad lamination, or formed such that a copper foil is attached to both surfaces of a metal plate containing iron.

The insulation layer may be coated such that parylene is vaporized and coated on the coil pattern in a uniform thickness.

The insulation layer may be formed in a thickness of approximately 3 um to approximately 100 um.

The power inductor may further include an external electrode formed outside the body and connected to the coil pattern.

The substrate may be provided in at least duplicate, and the coil pattern may be formed on each of the at least two or more substrates.

The power inductor may further include a connection electrode provided outside the body and configured to connect the at least two or more coil patterns.

The power inductor may further include at least two or more external electrodes connected to the at least two or more coil patterns, respectively, and formed outside the body.

The plurality of external electrodes may be formed on a same side surface of the body to be spaced apart from each other, or formed on side surfaces of the body that are different from each other.

The power inductor may further include a magnetic layer provided in at least one region of the body, and having magnetic permeability greater than that of the body.

The magnetic layer may be formed to include a heat conducting filler.

ADVANTAGEOUS EFFECTS

In the power inductor according to the embodiments of the present invention, the body may be manufactured by the metal powder, the polymer, and the thermal conductive filler. The thermal conductive filler may be provided to well release the heat of the body to the outside, and thus, the reduction of the inductance due to the heating of the body may be prevented.

Also, since the parylene is applied on the coil pattern, the parylene having the uniform thickness may be formed on the coil pattern, and thus, the insulation between the body and the coil pattern may be improved.

Also, the base material that is provided inside the body and on which the coil pattern is formed may be manufactured by using the metal magnetic material to prevent the power inductor from being deteriorated in magnetic permeability. In addition, at least one magnetic layer may be disposed on the body to improve the magnetic permeability of the power inductor.

Also, the at least two base materials of which the coil pattern having the coil shape is disposed on at least one surface to form the plurality of coil within one body, thereby increasing the capacity of the power inductor.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Hereinafter, embodiments will be described in more detail with reference to the accompanying drawings. The present disclosure may, however, be in different forms and should not be construed as limited to the embodiments set forth herein. Rather, these embodiments are provided so that this disclosure will be thorough and complete and will fully convey the scope of the present disclosure to those skilled in the art.

Figure 1:
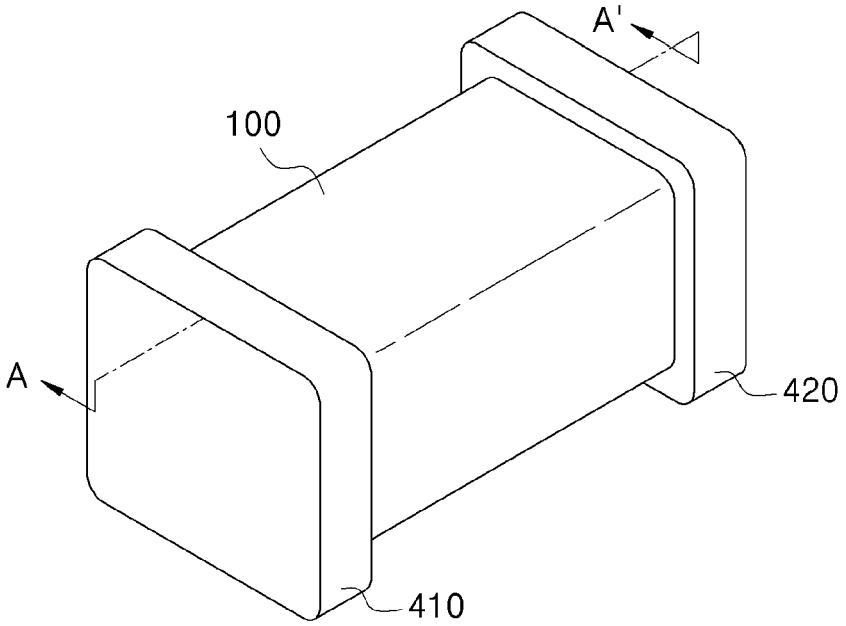
FIG. 1 is a perspective view of a power inductor in accordance with a first exemplary embodiment.
Figure 2:
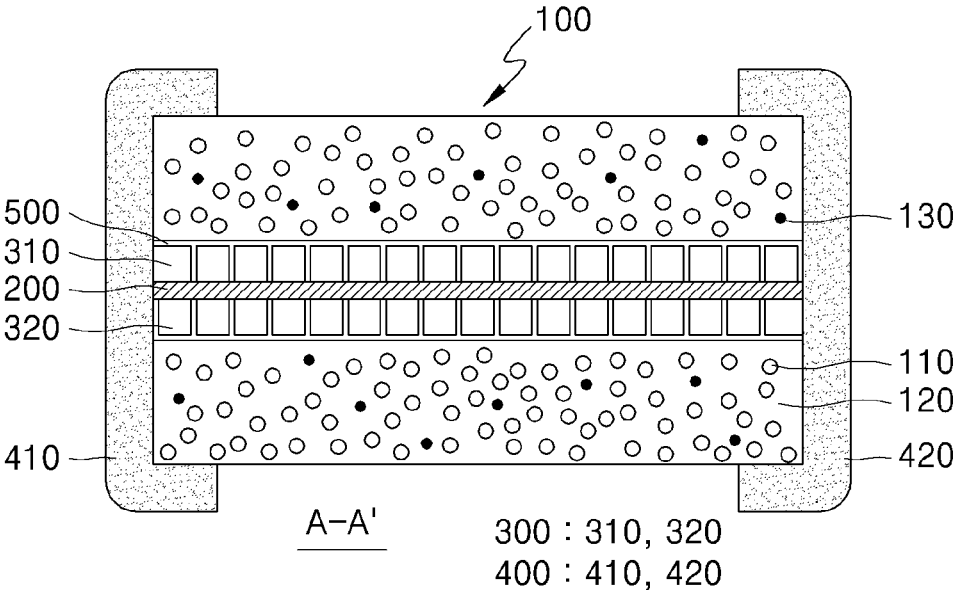
FIG. 2 is a cross-sectional view taken along line A-A' of FIG. 1.

FIG. 1 is a perspective view of a power inductor in accordance with an exemplary embodiment, and FIG. 2 is a cross-sectional view taken along line A-A' of FIG. 1.

Referring to FIGS. 1 and 2, a power inductor in accordance with a first exemplary embodiment may include a body 100 having a heat conducting filler 130, a substrate 200 disposed in the body 100, a coil pattern 300, 310 and 320 formed on at least one surface of the substrate 200, and an external electrode 400, 410 and 420 disposed outside the body 100. Also, an insulation layer 500 may be further included on the coil patterns 310 and 320.

The body 100 may have, for example, a hexahedron shape. However, the body 100 may have a polyhedron shape other than a hexahedron shape. This body 100 may include a metal powder 110, a polymer 120, and a heat conducting filler 130. The metal powder 110 may have an average particle diameter of approximately 1 um to approximately 50 um. Also, one kind of particles or two or more kinds of particles which have the same sizes may be used as the metal powder 110. Further, one kind of particles or two or more kinds of particles which have a plurality of sizes may also be used as the metal powder 110. For example, a mixture of first metal particles having an average size of approximately 30 um and second metal particles having an average size of approximately 3 um may be used. When two or more kinds of the metal powder 110 different from each other are used, capacity may be maximally implemented because the filling rate of the body 100 may be increased. For example, when a 30 um metal powder is used, a gap may be generated between the 30 um metal powders, and thus, the filling rate has to be decreased. However, the filling rate may be increased by using 3 um metal powder mixed between the 30 um metal powder. A metallic material containing iron (Fe) may be used for this metal powder 110. For example, one or more types of metal selected from the group consisting of iron-nickel (Fe—Ni), iron-nickel-silicon (Fe—Ni—Si), iron-aluminum-silicon (Fe—Al—Si), and iron-aluminum-chromium (Fe—Al—Cr), may be included in the metal powder 110. That is, the metal powder 110 may be formed of a metal alloy having a magnetic structure containing iron or a magnetic property and have a predetermined magnetic permeability. Also, the metal powder 110 may have a surface coated with ferrite material, and may be coated with a material having magnetic permeability different from the metal powder 110. For example, the ferrite material may be formed of a metal oxide ferrite material, and one or more oxide ferrite materials selected from the group consisting of nickel oxide ferrite material, zinc oxide ferrite material, copper oxide ferrite material, manganese oxide ferrite material, cobalt oxide ferrite material, barium oxide ferrite material, and nickel-zinc-copper oxide ferrite material may be used. That is, the ferrite materials coated on the surface of the metal powder 110 may be formed of a metal oxide containing iron, and may have a magnetic permeability greater than that of the metal powder 110. Since the metal powder 110 is magnetic, a short caused by insulation breakdown may occur if the metal powders 110 contact each other. Accordingly, the surface of the metal powder 110 may be coated with at least one insulator. For example, while the surface of the metal powder 110 may be coated with oxides or insulating polymer materials such as parylene, it may be preferably coated with parylene. The parylene may be coated at a thickness of approximately 1 um to approximately 10 um. Here, when the parylene is formed in a thickness less than approximately 1 um, the insulation effect of the metal powder 110 may be decreased, and when the parylene is formed in a thickness greater than approximately 10 um, the size of the metal powder 110 is increased, the distribution of the metal powder 110 in the body 100 is decreased, and thus, magnetic permeability may be decreased. Also, the surface of the metal powder 110 may be coated with various insulating polymer materials other than parylene. Oxides coating the metal powder 110 may be formed by oxidizing the metal powder 110, and alternatively, one selected from $TiO_2$, $SiO_2$, $ZrO_2$, $SnO_2$, NiO, ZnO, CuO, CoO, MnO, MgO, $Al_2O_3$, $Cr_2O_3$, $Fe_2O_3$, $B_2O_3$, and $Bi_2O_3$ may be coated on the metal powder 110. Here, the metal powder 110 may be coated with an oxide with a dual structure, or coated with a dual structure of an oxide and a polymer material. Of course, the surface of the metal powder 110 may be coated with an insulator after being coated with a ferrite material. The surface of the metal powder 110 is thus coated with an insulator, so that a short caused by the contact between the metal powders 110 may be prevented. Here, even when the metal powder 110 is coated with an oxide, an insulating polymer material, or the like, or dually coated with a ferrite and an insulator, the metal powder 110 may be coated in a thickness of approximately 1 um to approximately 10 um. The polymer 120 may be mixed with the metal powder 110 to insulate the metal powders 110 from each other. That is, while the metal powder 110 may have a limitation in that the loss of material is increased because eddy current loss and hysteresis loss at high frequencies are increased, the polymer 120 may be included to reduce the loss of material and insulate the metal powder 110 from each other. This polymer 120 may include, but is not limited to, one or more polymers selected from the group consisting of epoxy, polyimide, and liquid crystalline polymer (LCP). Also, the polymer 120 may be formed of a thermoplastic resin providing insulation between the metal powders 110. As a thermoplastic resin, one or more selected from the group consisting of novolac epoxy resin, phenoxy type epoxy resin, BPA type epoxy resin, BPF type epoxy resin, hydrogenated BPA epoxy resin, dimer acid modified epoxy resin, urethane modified epoxy resin, rubber modified epoxy resin, and DCPD type epoxy resin may be included. Here, the polymer 120 may be included in an amount of approximately from 2.0 wt % to approximately 5.0 wt % with respect to 100 wt % of the metal powder. However, when the amount of the polymer 120 is increased, the volume fraction of the metal powder 110 is reduced, and there may be a limitation in that the effect of increasing saturation magnetization value is not properly achieved and the magnetic property—that is, the magnetic permeability of the body 100 may be decreased. Also, when the amount of the polymer 120 is decreased, there may be a limitation in that the inductance characteristic is decreased because a strong acid solution, a strong base solution, or the like, which is used in manufacturing an inductor, penetrates inward. Accordingly, the polymer 120 may be included in a range which does not reduce the saturation magnetization value and the inductance of the metal powder 110. Also, a heat conducting filler 130 is included to solve the limitation that the body 100 is heated by external heat. That is, while the metal powder 110 in the body 100 is heated by external heat, the heat of the metal powder 110 may be dissipated to the outside by including the heat conducting filler 130. This heat conducting filler 130 may include, but is not limited to, one or more selected from the group consisting of MgO, AlN, and carbon based materials. Here, the carbon based materials may include carbon and have various shapes. For example, graphite, carbon black, graphene, graphite, or the like may be included. Also, the heat conducting filler 130 may be included in an amount of approximately from 0.5 wt % to approximately 3 wt % with respect to 100 wt % of the metal powder 110. When the amount of the heat conducting filler 130 is smaller than the above-described range, a heat dissipation effect may not be achieved, and when the amount is greater than the above-described range, the magnetic permeability of the metal powder 110 may be decreased. Also, the heat conducting filler 130 may have, for example, a size of approximately 0.5 um to approximately 100 um. That is, the heat conducting filler 130 may have a size greater than or smaller than the metal powder 110. The body 100 may be manufactured by laminating a plurality of sheets formed of a material including a metal powder 110, a polymer 120 and a heat conducting filler 130. Here, when the body 100 is manufactured by laminating a plurality of sheets, the included amount of the heat conducting filler 130 of each sheet may be different. For example, the amount of the heat conducting filler 130 in the sheets may progressively increase upwardly or downwardly away from the substrate 200. Also, the body 100 may be formed by printing a paste, which is formed of a material including a metal powder 110, a polymer 120, and a heat conducting filler 130 in a predetermined thickness. Alternatively, the body 100 may be formed, if necessary, through various methods, such as a method in which this paste is charged into a form and pressed. Here, the number of sheets laminated to form the body 100 or the thickness of the paste printed in a predetermined thickness may be determined as an appropriate number or thickness in consideration of electric characteristics such as inductance required for a power inductor.

The substrate 200 may be disposed inside the body 100. At least one or more of the substrate 200 may be provided. For example, the substrate 200 may be disposed inside the body 100 along a lengthwise direction of the body 100. Here, one or more of the substrate 200 may be provided. For example, two substrates 200 may be disposed to be spaced apart from each other at predetermined intervals in a direction perpendicular to the direction along which external electrodes 400 are formed—for example, in a vertical direction. This substrate 200 may be formed of, for example, a copper clad lamination (CCL) or a metallic ferrite material. Here, the substrate 200 is formed of a metal ferrite material, so that magnetic permeability may be increased and capacity may be easily realized. That is, CCL is manufactured by attaching a copper foil to a glass reinforced fiber. However, since CCL has no magnetic permeability, the magnetic permeability of the power conductor may be decreased thereby. However, when the metal ferrite material is used as the substrate 200, the magnetic permeability of the power inductor may not be decreased because the metal ferrite material has magnetic permeability. This substrate 200 using the metallic ferrite material may be manufactured by attaching a copper foil to a plate which has a predetermined thickness and is formed of a metal containing iron—for example, one or more metal selected from the group consisting of iron-nickel (Fe—Ni), iron-nickel-silicon (Fe—Ni—Si), iron-aluminum-silicon (Fe—Al—Si), and iron-aluminum-chromium (Fe—Al—Cr). That is, an alloy formed of at least one metal including iron is manufactured into a plate shape with a predetermined thickness. Then a copper foil is attached to at least one surface of the metal plate, and thus, the substrate 200 may be manufactured. Also, in a predetermined region of the substrate 200, at least one conductive via (not shown) may be provided, and coil patterns 310 and 320 respectively provided in upper and lower sides of the substrate 200 may be electrically connected by the conductive via. The conductive via may be provided through a method in which a via (not shown) passing through the substrate 200 in a thickness direction is formed in the substrate 200, and a conductive paste is then charged into the via.

The coil pattern 300, 310, and 320 may be provided on at least one surface, and preferably on both surfaces of the substrate 200. This coil patterns 310 and 320 may be formed in a spiral shape in a direction from a predetermined region of the substrate 200, for example, from a central portion to the outside, and one coil may be defined in such a way that two coil patterns 310 and 320 formed on the substrate 200 are connected. Here, the upper and lower coil patterns 310 and 320 may be formed in a shape the same as each other. Also, the coil patterns 310 and 320 may be formed to overlap each other, and the coil pattern 320 may be formed to overlap a region on which the coil pattern 310 is not formed. These coil patterns 310 and 320 may be electrically connected by the conductive via formed on the substrate 200. The coil patterns 310 and 320 may be formed through a method such as thick film printing, spreading, depositing, plating, or sputtering. Also, the coil patterns 310 and 320 and the conductive via may be formed of, but are not limited to, a material including at least one of silver (Ag), copper (Cu), and copper alloy. Meanwhile, when the coil patterns 310 and 320 are formed through a plating process, a metal layer such as copper layer may be formed on, for example, the substrate 200 through a plating process, and patterned through a lithography process. That is, the coil patterns 310 and 320 may be formed on the surface of the substrate 200 through forming a copper layer on a seed layer, which is a copper foil formed on the surface of the substrate 200, through a plating process, and patterning the layer. Of course, the coil patterns 310 and 320 with a predetermined shape may also be formed in such a way that a photosensitive film pattern with a predetermined shape is formed on the substrate 200, a metal layer is then grown from the exposed surface of the substrate 200 by performing a plating process, and the photosensitive film is then removed. The coil patterns 310 and 320 may also be formed in a multilayer. That is, a plurality of coil patterns may further be formed over the coil pattern 310 formed over the substrate 200, and a plurality of coil patterns may further be formed under the coil pattern 320 formed under the substrate 200. When the coil patterns 310 and 320 are formed in a multilayer, an insulation layer is formed between the upper and lower layers, a conductive via (not shown) is formed in the insulation layer, and thus, a multilayered coil pattern may be connected.

The external electrode 400, 410, and 420 may be formed at both end portions of the body 100. For example, the external electrode 400 may be formed on two side surfaces facing each other in the longitudinal direction of the body 100. This external electrode 400 may be electrically connected to the coil patterns 310, 320 of the body 100. That is, at least one end portion of the coil patterns 310 and 320 is exposed to the outside of the body 100, and the external electrode 400 may be formed so as to be connected to end portions of the coil patterns 310 and 320. This external electrode 400 may be formed such that the body 100 is dipped into a conductive paste, or through various methods such as printing, depositing, or sputtering, at both ends of the body 100. The external electrode 400 may be formed of a metal having electrical conductivity. For example, one or more metals selected from the group consisting of gold, silver, platinum, copper, nickel, palladium, and an alloy thereof. Also, a nickel-plated layer (not shown) or a tin-plated layer (not shown) may further be formed on the surface of the external electrode 400.

The insulation layer 500 may be formed between the coil patterns 310 and 320 and the body 100 to insulate the coil patterns 310 and 320 and the metal powder 110. That is, the insulation layer 500 may be formed on upper and lower portions of the substrate 200 to cover the coil patterns 310 and 320. This insulation layer 500 may be formed such that parylene is coated on the coil patterns 310 and 320. For example, parylene may be deposited on the coil patterns 310 and 320 by providing the substrate 200 with a coil patterns 310 and 320 formed thereon inside a deposition chamber, and then vaporizing parylene and supplying the vaporized parylene into a vacuum chamber. For example, parylene is firstly heated and vaporized in a vaporizer to be converted into a dimer state as in Formula 1, and is then secondly heated and thermally decomposed into a monomer state as in Formula 2. When the parylene is then cooled by using a cold trap provided to be connected to a decomposition chamber and a mechanical vacuum pump, the parylene is converted from a monomer state to a polymer state as in Formula 3 and deposited on the coil patterns 310 and 320. Of course, the insulation layer 500 may be formed of an insulating polymer other than parylene—for example, one or more material selected from epoxy, polyimide, and liquid crystalline polymer. However, an insulation layer 500 may be formed in a uniform thickness on the coil patterns 310 and 320 through coating with parylene, and even when formed in a small thickness, insulation characteristics may be improved in comparison with other materials. That is, when coated with parylene as an insulation layer 500, insulation characteristics may be improved by increasing insulation breakdown voltage while the insulation layer 500 is formed in a smaller thickness than in the case of forming polyimide. Also, the insulation layer 500 may be formed in a uniform thickness by filling a gap between the patterns according to a distance between the coil patterns 310 and 320, or may be formed in a uniform thickness along a step in the pattern. That is, when the distance between the coil patterns 310 and 320 is large, parylene may be coated in a uniform thickness along the step in the pattern. Also, when the distance between the coil patterns 310 and 320 is small, parylene may be formed in a predetermined thickness on the coil patterns 310 and 320 by filling the gap between the patterns. Here, the insulation layer 500 may be formed in a thickness of approximately 3 um to approximately 100 um by using parylene. When parylene is formed in a thickness smaller than approximately 3 um, insulation characteristics may be decreased. Also, when parylene is formed in a thickness greater than approximately 100 um, the thickness occupied by the insulation layer 500 within the same size is increased, the volume of the body 100 becomes small, and thus, magnetic permeability may be decreased. Of course, the insulation layer 500 may be formed on the coil patterns 310 and 320 after being formed of a sheet with a predetermined thickness.

(Formula 1)

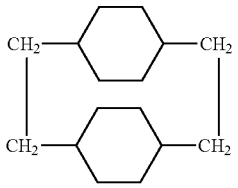

(Formula 2)

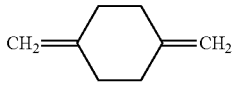

(Formula 3)

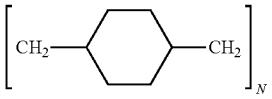

As described above, the power inductor in accordance with the first exemplary embodiment may improve insulation characteristics even though the insulation layer 500 is formed in a smaller thickness by forming the insulation layer 500 between the coil patterns 310 and 320 and the body 100 by using parylene. Also, the body 100 is manufactured to include a heat conducting filler 130 as well as the metal powder 110 and the polymer 120, so that the heat of the body 100 generated by heating the metal powder 110 may be dissipated to the outside. Accordingly, a temperature rise in the body 100 may be prevented, and limitations such as a decrease in inductance may thus be prevented. Also, the decrease in the magnetic permeability of the power inductor may be prevented by allowing the substrate 200 inside the body 100 to be formed of a metallic ferrite material.

Figure 3:
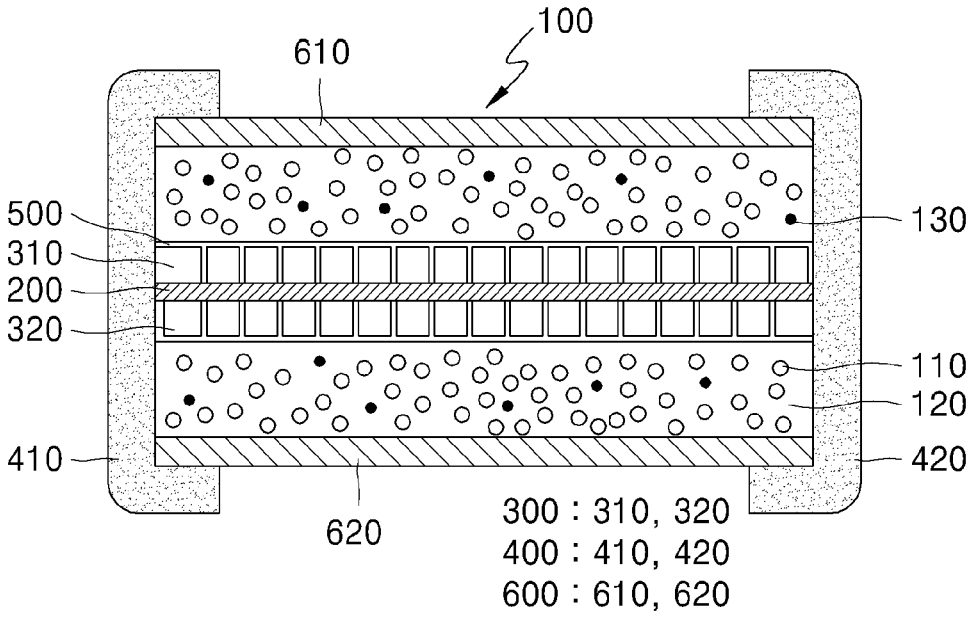
FIGS. 3 to 5 are cross-sectional views of power inductors in accordance with second exemplary embodiments.

FIG. 3 is a perspective view of a power inductor in accordance with a second exemplary embodiment.

Referring to FIG. 3, a power inductor in accordance with a second exemplary embodiment may include a body 100 having a heat conducting filler 130, a substrate 200 disposed in the body 100, coil patterns 300, 310 and 320 formed on at least one surface of the substrate 200, external electrodes 410 and 420 disposed outside the body 100, insulation layers 500 respectively disposed on the coil patterns 310 and 320, and at least one magnetic layer 600, 610, and 620 respectively disposed over and under the body 100. That is, an exemplary embodiment may further include the magnetic layer 600 to implement another exemplary embodiment. This second exemplary embodiment will be mainly described as follows in relation to configurations different from the first exemplary embodiment.

The magnetic layer 600, 610 and 620 may be provided in at least one region of the body 100. That is, a first magnetic layer 610 may be formed on an upper surface of the body 100, and a second magnetic layer 620 may be formed on a lower surface of the body 100. Here, the first and second magnetic layers 610 and 620 are provided to increase the magnetic permeability of the body 100, and may be formed of a material having a magnetic permeability greater than the body 100. For example, the body 100 may be provided to have a magnetic permeability of approximately 20, and the first and second magnetic layers 610 and 620 may be provided to have a magnetic permeability of approximately 40 to approximately 1000. These first and second magnetic layers 610 and 620 may be manufactured, for example, by using a ferrite powder and a polymer. That is, the first and second magnetic layers 610 and 620 may be formed of a material with a magnetic permeability greater than the ferrite material of the body 100 so as to have magnetic permeability greater than the body 100, or formed to have greater content of ferrite materials. Here, the polymer may be included in an amount of approximately 15 wt % with respect to 100 wt % of the metal powder. Also, one or more selected from the group consisting of Ni ferrite, Zn ferrite, Cu ferrite, Mn ferrite, Co ferrite, Ba ferrite, and Ni—Zn—Cu ferrite or one or more oxide ferrite thereof may be used as the ferrite powder. That is, the magnetic layer 600 may be formed by using a metal alloy powder containing iron or a metal alloy oxide containing iron. Also, the ferrite powder may be formed by coating a metal alloy powder with ferrite. For example, the ferrite powder may be formed through coating, for example, the metal alloy powder containing iron with one or more oxide ferrite material selected from the group consisting of nickel oxide ferrite material, zinc oxide ferrite material, copper oxide ferrite material, manganese oxide ferrite material, cobalt oxide ferrite material, barium oxide ferrite material, and nickel-zinc-copper oxide ferrite material. That is, the ferrite powder may be formed through coating a metal alloy powder with a metal oxide containing iron. Of course, the ferrite powder may be formed through mixing, for example, the metal alloy powder containing iron with one or more oxide ferrite material selected from the group consisting of nickel oxide ferrite material, zinc oxide ferrite material, copper oxide ferrite material, manganese oxide ferrite material, cobalt oxide ferrite material, barium oxide ferrite material, and nickel-zinc-copper oxide ferrite material. That is, the ferrite powder may be formed through mixing a metal alloy powder with a metal oxide containing iron. The first and second magnetic layers 610 and 620 may be formed to further include a heat conducting filler with the metal powder and the polymer. The heat conducting filler may be included in an amount of approximately 0.5 wt % to approximately 3 wt % with respect to 100 wt % of the metal powder. These first and second magnetic layers 610 and 620 may be formed in a sheet shape, and respectively disposed over and under the body 100 in which a plurality of sheets are laminated. Also, after the body 100 is formed through printing a paste, which is formed of a material including the metal powder 110, the polymer 120, and the heat conducting filler 130, in a predetermined thickness, or formed through charging the paste into a form and pressing the paste, the magnetic layers 610 and 620 may be respectively formed over and under the body 100. Of course, the magnetic layers 610 and 620 may also be formed by using a paste, and the magnetic layers 610 and 620 may be formed by applying a magnetic material over and under the body 100.

Figure 4:
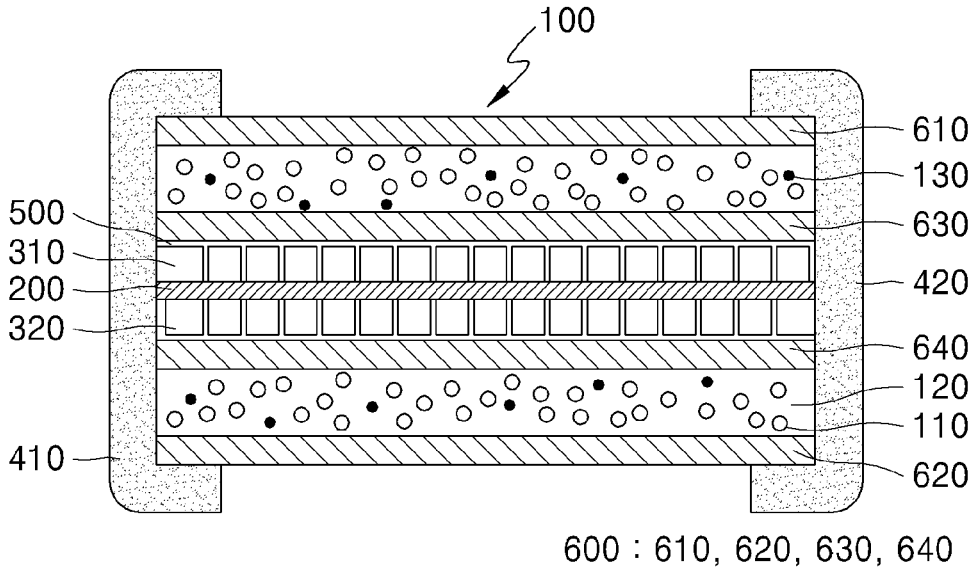
Figure 5:
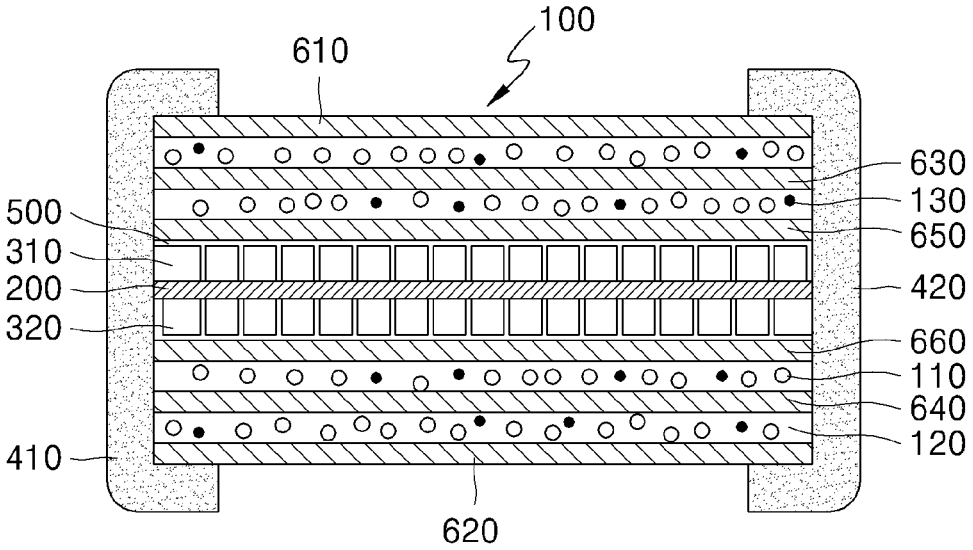

A power inductor in accordance with a second exemplary embodiment, as illustrated in FIG. 4, may further include third and fourth magnetic layers 630 and 640 in upper and lower portions between a body 100 and a substrate 200, and as described in FIG. 5, a fifth and sixth magnetic layers 650 and 660 may be further included therebetween. That is, at least one magnetic layer 600 may be included in the body 100. This magnetic layer 600 may be formed in a sheet shape, and disposed in the body 100 in which a plurality of sheets are laminated. That is, at least one magnetic layer 600 may be provided between the plurality of sheets for manufacturing the body 100. Also, when the body 100 is formed through printing a paste, which is formed of a material including a metal powder 110, a polymer 120, and a heat conducting filler 130, in a predetermined thickness, the magnetic layer may be formed during the printing. Also, when the body 100 is formed through charging the paste into a form and pressing the paste, the magnetic layer may be inputted therebetween and pressed. Of course, the magnetic layers 600 may also be formed by using a paste. The magnetic layer 600 may be formed in the body 100 by applying a soft magnetic material when the body 100 is printed.

As described above, the power inductor in accordance with the other exemplary embodiment may improve the magnetic permeability of the power inductor by providing the body 100 with at least one magnetic layer 600.

Figure 6:
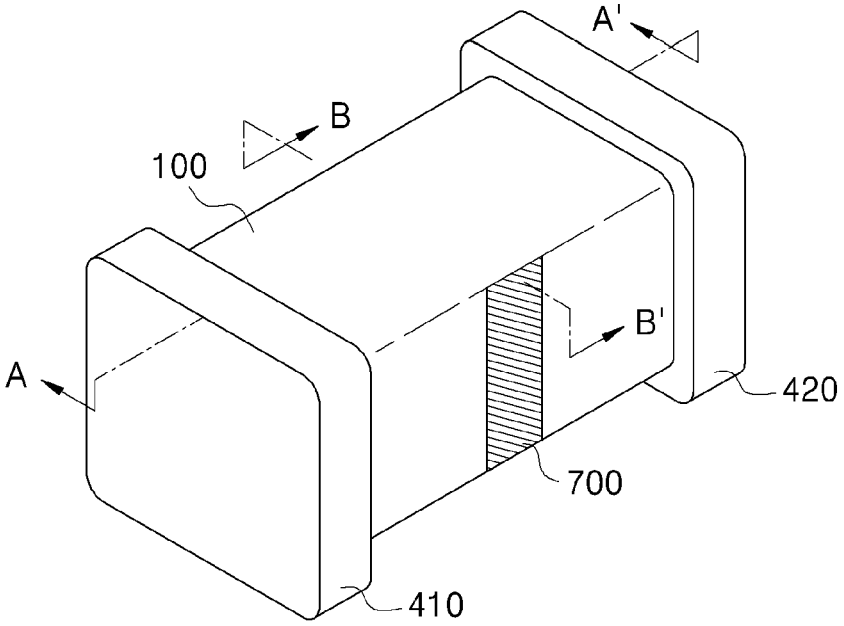
FIG. 6 is a perspective view of a power inductor in accordance with a third exemplary embodiment.
Figure 7:
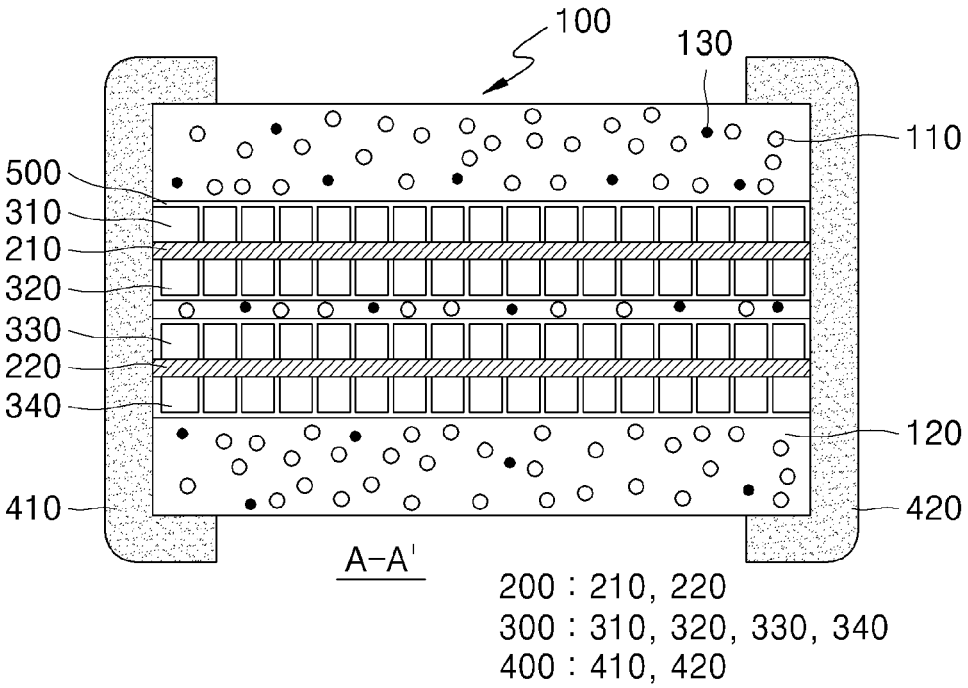
FIGS. 7 and 8 are cross-sectional views respectively taken along lines A-A' and B-B' of FIG. 6.
Figure 8:
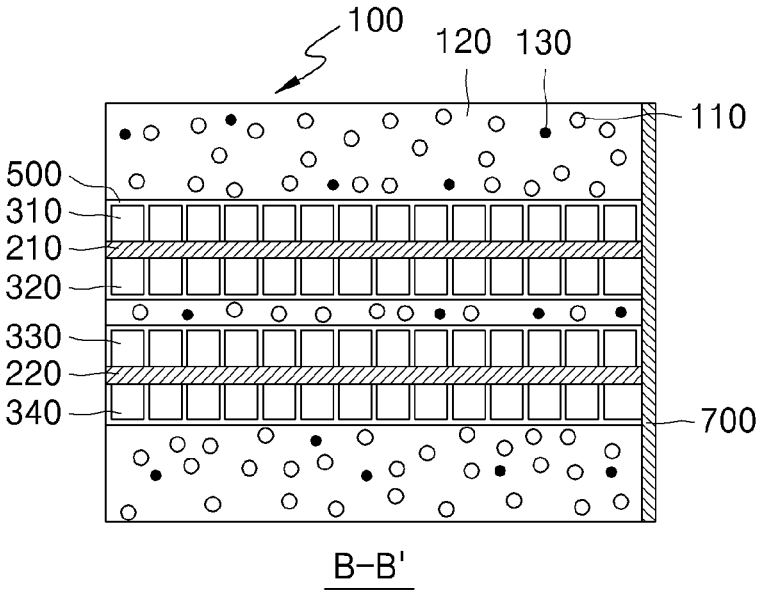

FIG. 6 is a perspective view of a power inductor in accordance with a third exemplary embodiment, FIG. 7 is a cross-sectional view taken along line A-A' of FIG. 6, and FIG. 8 is a cross-sectional view taken along line B-B' of FIG. 6.

Referring to FIGS. 6 to 8, a power inductor in accordance with a third exemplary embodiment may include a body 100; at least two or more substrates 200, 210, and 220 disposed inside the body 100; coil patterns 300, 310, 320, 330, and 340 formed on at least one surface of each of the two or more substrates 200; external electrodes 410 and 420 disposed outside the body 100; an insulation layer 500 formed on the coil pattern 300; and a connection electrode 700 disposed outside the body 100 to be spaced apart from the external electrodes 410 and 420, and connected to at least one coil pattern 300 formed on each of the at least two or more substrates 200 inside the body 100. Hereinafter, the descriptions overlapping with the one exemplary embodiment and the other exemplary embodiment will not be provided.

At least two or more substrates 200, 210, and 220 may be disposed inside the body 100. For example, the at least two or more substrates 200 may be disposed along a longitudinal direction of the body 100 inside the body 100, and spaced apart from each other in a thickness direction of the body 100.

The coil patterns 300, 310, 320, 330, and 340 may be provided on at least one surface, and preferably on both surfaces of the at least two or more substrates 200. Here, the coil patterns 310 and 320 may be formed respectively under and over the first substrate 210, and electrically connected through a conductive via formed on the first substrate 210. Likewise, the coil patterns 330 and 340 may be formed respectively under and over the second substrate 220, and electrically connected through a conductive via formed on the second substrate 220. These coil patterns 300 may be formed in a spiral shape in a direction from a predetermined region of the substrate 200—for example, from a central portion to the outside, and one coil may be defined in such a way that two coil patterns formed on the substrate 200 are connected. That is, two or more coils may be formed in one body 100. Here, the coil patterns 310 and 330 over the substrate 200 and the coil patterns 320 and 340 under the substrate 200 may be formed in shapes the same as each other. Also, the plurality of coil patterns 300 may be formed to overlap with each other, or the lower coil patterns 320 and 340 may also be formed to overlap with a region in which the upper coil patterns 310 and 330 are not formed.

The external electrodes 400, 410, and 420 may be formed at both end portions of the body 100. For example, the external electrodes 400 may be formed on two side surfaces facing each other in the longitudinal direction of the body 100. This external electrode 400 may be electrically connected to the coil pattern 300 of the body 100. That is, at least one end portion of the plurality of coil patterns 300 may be exposed to the outside of the body 100, and the external electrode 400 may be formed so as to be connected to end portions of the plurality of coil patterns 300. For example, the coil pattern 310 may be formed to be connected to the coil patterns 310 and 330, and the coil pattern 320 may be formed to be connected to the coil patterns 320 and 340.

The connection electrode 700 may be formed on at least one side surface of the body 100 at which the external electrode 400 is not formed. This connection electrode 700 is provided to connect at least one of the coil patterns 310 and 320 formed on the first substrate 210 and at least one of the coil patterns 330 and 340 formed on the second substrate 220. Accordingly, the coil patterns 310 and 320 formed on the first substrate 210 and the coil patterns 330 and 340 formed on the second substrate 220 may be electrically connected to each other through the connection electrode 700 outside the body 100. This connection electrode 700 may be formed at one side of the body 100 by dipping the body 100 into a conductive paste or through various methods such as printing, depositing, or sputtering. The connection electrode 700 may be formed of a metal having electrical conductivity, for example, including one or more metals selected from the group consisting of gold, silver, platinum, copper, nickel, palladium, and an alloy thereof. Here, a nickel-plated layer (not shown) or a tin-plated layer (not shown) may further be formed on the surface of the connection electrode 700, if necessary.

As described above, the power inductor in accordance with the third exemplary embodiment includes, in the body 100, at least two or more substrates 200 having coil patterns 300 respectively formed on at least one surface thereof, so that a plurality of coils may be formed in one body 100. Thus, the capacity of the power inductor may be increased.

Figure 9:
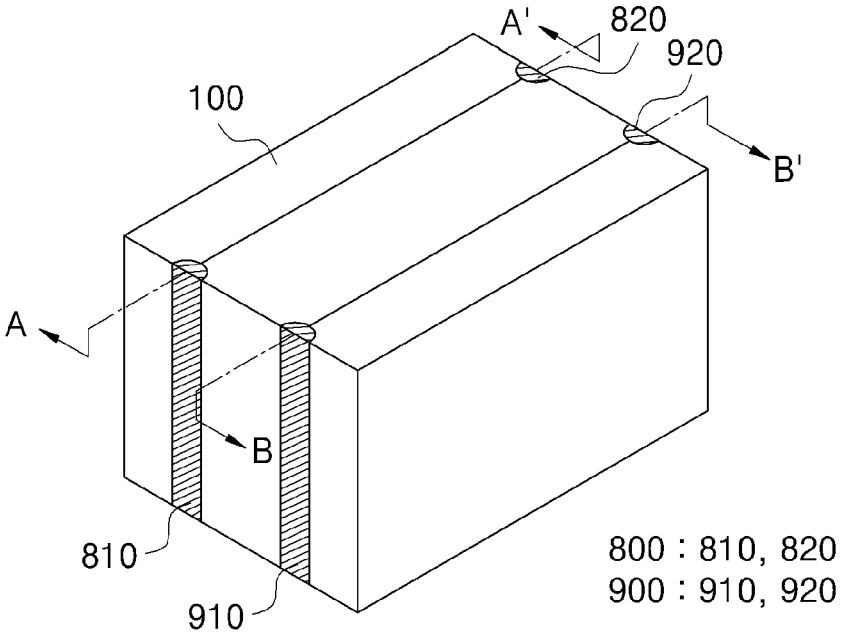
FIG. 9 is a perspective view of a power inductor in accordance with a fourth exemplary embodiment.
Figure 10:
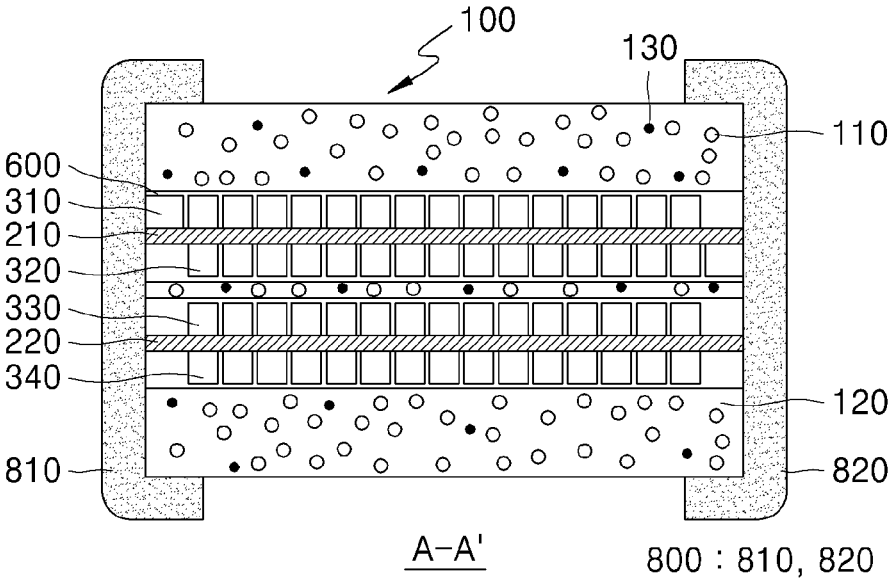
FIGS. 10 and 11 are cross-sectional views respectively taken along lines A-A' and B-B' of FIG. 9.
Figure 11:
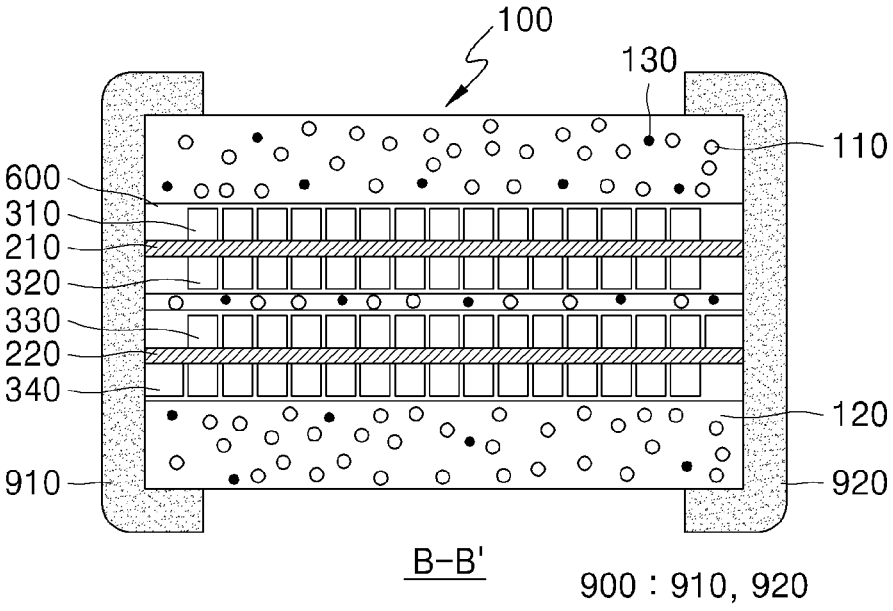

FIG. 9 is a perspective view of a power inductor in accordance with a fourth exemplary embodiment, and FIGS. 10 and 11 are cross-sectional views respectively taken along line A-A' and line B-B' of FIG. 9.

Referring to FIGS. 9 to 11, a power inductor in accordance with a fourth exemplary embodiment may include a body 100; at least two or more substrates 200, 210, and 220 disposed inside the body 100; coil patterns 300, 310, 320, 330, and 340 formed on at least one surface of each of the two or more substrates 200; first external electrodes 800, 810, and 820 disposed on two side surfaces of the body 100 facing each other and respectively connected to the coil patterns 310 and 320, and second external electrodes 900, 910, and 920 disposed to be spaced apart from the first external electrodes 800, 810, and 820 on the two side surfaces of the body 100 facing each other and respectively connected to the coil patterns 330 and 340. That is, the coil patterns 300 respectively formed on at least two or more substrates 200 are connected by the respectively different first and second external electrodes 800 and 900, so that two or more power inductors may be implemented in one body 100.

The first external electrodes 800, 810, and 820 may be formed at both end portions of the body 100. For example, the first external electrodes 810 and 820 may be formed on two side surfaces facing each other in the longitudinal direction of the body 100. These first external electrodes 810 and 820 may be electrically connected to the coil patterns 310 and 320 formed on the first substrate 210. That is, at least one end portion, respectively, of the coil patterns 310 and 320 are exposed to the outside of the body 100 in mutually facing directions, and the first external electrodes 810 and 820 may be formed so as to be connected to end portions of the coil patterns 310 and 320. These first external electrodes 810 may be formed at both ends of the body 100 by dipping the body 100 into a conductive paste or through various methods such as printing, depositing, and sputtering, and then patterned. Also, the first external electrodes 810 and 820 may be formed of a metal having electrical conductivity, for example, one or more metals selected from the group consisting of gold, silver, platinum, copper, nickel, palladium, and an alloy thereof. Also, a nickel-plated layer (not shown) or a tin-plated layer (not shown) may further be formed on the surfaces of the first external electrodes 810 and 820.

The second external electrodes 900, 910, and 920 may be formed at both end portions of the body 100, and spaced apart from the first external electrodes 810 and 820. That is, the first external electrodes 810 and 820 and the second external electrodes 910 and 920 may be formed on a same surface of the body 100, and formed to be spaced apart from each other. These second external electrodes 910 and 920 may be electrically connected to the coil patterns 330 and 340 formed on the second substrate 220. That is, at least one end portion, respectively, of the coil patterns 330 and 340 are exposed to the outside of the body 100 in a direction facing each other, and the second external electrodes 910 and 920 may be formed so as to be connected to end portions of the coil patterns 330 and 340. Here, although the coil patterns 330 and 340 are exposed in the same direction as the coil patterns 310 and 320, the coil patterns 330 and 340 may be respectively connected to the first and second external electrodes 800 and 900 by being exposed while not overlapping with each other but being spaced apart a predetermined distance from each other. These second external electrodes 910 and 920 may be formed through the same process as the first external electrodes 810 and 820. That is, the second external electrodes 910 may be formed at both ends of the body 100 by dipping the body 100 into a conductive paste, or through various methods such as printing, depositing, and sputtering, and then patterned. Also, the second external electrodes 910 and 920 may be formed of a metal having electrical conductivity, for example, one or more metals selected from the group consisting of gold, silver, platinum, copper, nickel, palladium, and an alloy thereof. Also, a nickel-plated layer (not shown) or a tin-plated layer (not shown) may further be formed on the surfaces of the second external electrodes 910 and 920.

Figure 12:
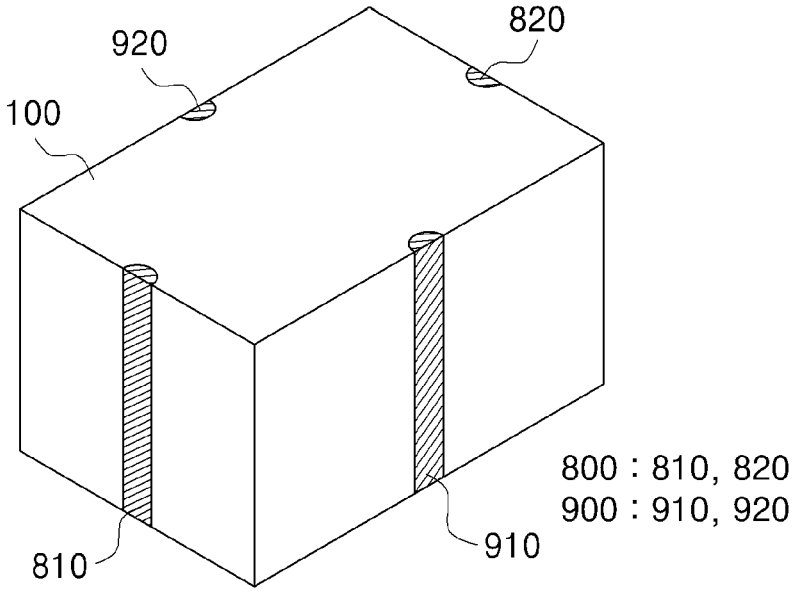
FIG. 12 is a perspective view of a power inductor in accordance with a modified exemplary embodiment of the fourth exemplary embodiment.

FIG. 12 is a perspective view of a power inductor in accordance with a modified exemplary embodiment of the fourth exemplary embodiment, and first external electrodes 810 and 820 and second external electrodes 910 and 920 are formed in a direction different from each other. That is, the first external electrodes 810 and 820 and the second external electrodes 910 and 920 may be formed on side surfaces of the body 100 that are perpendicular to each other. For example, the first external electrodes 810 and 820 may be formed on two side surfaces facing each other in a longitudinal direction of the body 100, and the second external electrodes 910 and 920 may be formed on two side surfaces facing each other in a transverse direction of the body 100.

Figure 13:
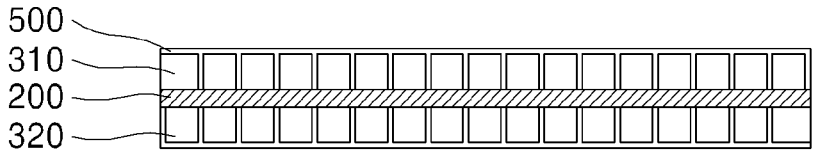
FIGS. 13 to 15 are cross-sectional views sequentially illustrating a method of manufacturing a power inductor in accordance with an exemplary embodiment.
Figure 14:
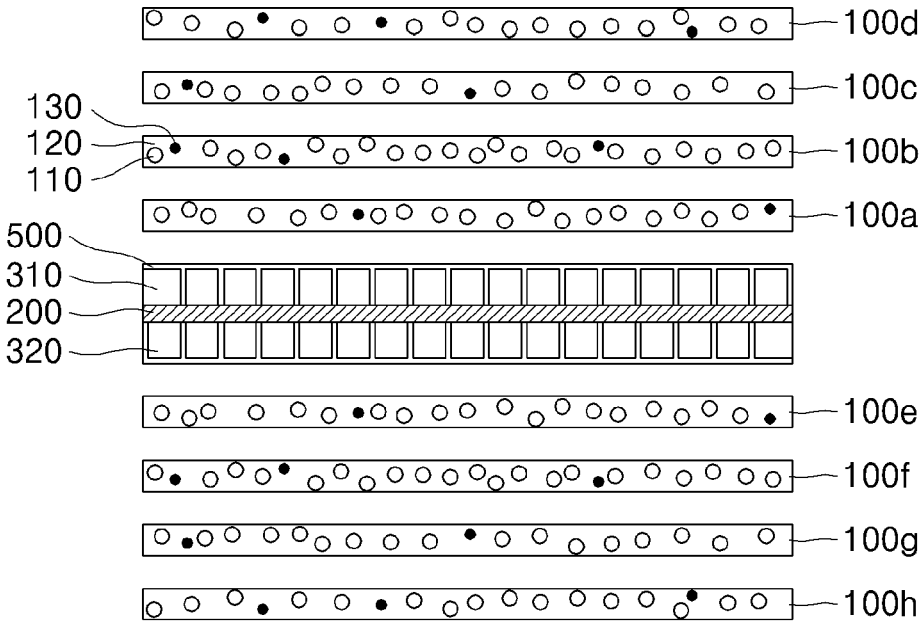
Figure 15:
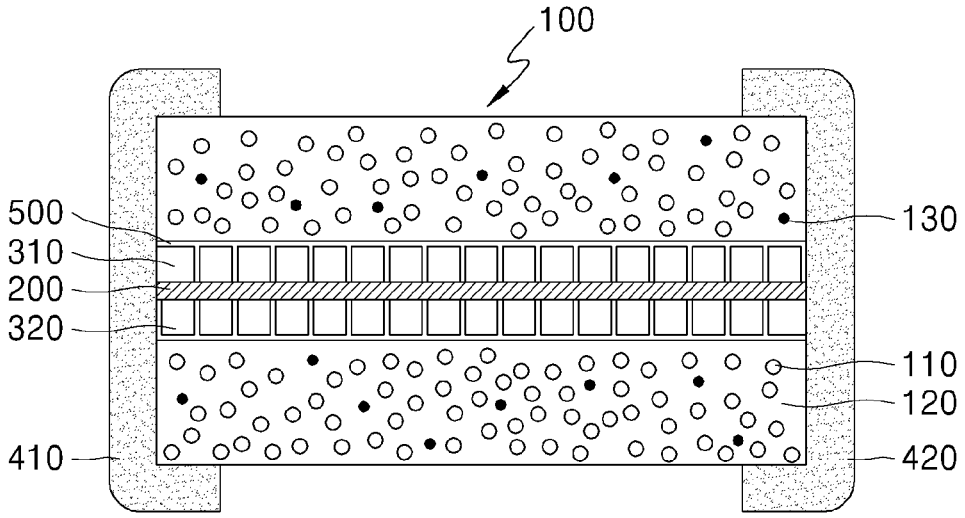

FIGS. 13 to 15 are cross-sectional views sequentially illustrating a method of manufacturing a power inductor in accordance with an exemplary embodiment.

Referring to FIG. 13, coil patterns 310 and 320 with predetermined shapes are formed on at least one surface of a substrate 200 or preferably on one surface and the other surface of the substrate 200. The substrate 200 may be formed of a CCL, a metal ferrite, or the like, and preferably formed of a metal ferrite which may increase effective magnetic permeability and allow capacity to be easily realized. For example, the substrate 200 may be manufactured by attaching a copper foil to one surface and the other surface of a metal plate with a predetermined thickness and formed of a metal alloy containing iron. Also, the coil patterns 310 and 320 may be formed as a coil pattern formed in a circular spiral shape from a predetermined region of the substrate 200, for example, from the central portion. Here, after the coil pattern 310 is formed on the one surface of the substrate 200, a conductive via passing through a predetermined region of the substrate 200 and filled with a conductive material is formed, and the coil pattern 320 may be formed on the other surface of the substrate 200. The conductive via may be formed by forming a via hole by using laser or the like in a thickness direction of the substrate 200 and filling the via hole with a conductive paste. Also, the coil pattern 310 may be formed through, for example, a plating process. For this, a photosensitive film pattern with a predetermined shape is formed on one surface of the substrate 200. Then, a plating process is performed by using a copper foil on the substrate 200 as a seed, and the coil pattern 310 may be formed through removing the photosensitive film after a metal layer is grown from the exposed surface of the substrate 200. Of course, the coil pattern 320 may be formed on the other surface of the substrate 200 through the same method used to form the coil pattern 310. The coil patterns 310 and 320 may also be formed in a multilayer. When the coil patterns 310 and 320 are formed in a multilayer, an insulation layer is formed between the upper and lower layers, a conductive via (not shown) is formed in the insulation layer, and thus, a multilayered coil pattern may be connected. In this manner, after the coil patterns 310 and 320 are respectively formed on the one surface and the other surface of the substrate 200, an insulation layer 500 is formed to cover the coil patterns 310 and 320. The insulation layer 500 may be formed by being coated with an insulating polymer material such as parylene. That is, parylene may be deposited on the coil patterns 310 and 320 by providing the substrate 200 with the coil patterns 310 and 320 formed thereon inside a deposition chamber, and then vaporizing and supplying parylene into a vacuum chamber. For example, parylene is firstly heated and vaporized in a vaporizer to be converted into a dimer state, and is then secondly heated and thermally decomposed into a monomer state. When the parylene is then cooled by using a cold trap provided to be connected to the decomposition chamber and a mechanical vacuum pump, the parylene is converted from a monomer state to a polymer state and deposited on the coil patterns 310 and 320. Here, the first heating process for vaporizing and converting parylene into the dimmer state may be performed at a temperature of approximately 100° C. to approximately 200° C. and a pressure of approximately 1.0 Torr. The second heating process for thermally decomposing the vaporized parylene and converting the parylene to a monomer state may be performed at a temperature of approximately 400° C. to approximately 500° C. and a pressure of approximately 0.5 Torr or more. Also, in order that parylene may be deposited by converting a monomer state into a polymer state, the deposition chamber may be maintained at room temperature, for example, approximately 25° C. and a pressure of approximately 0.1 Torr. In this manner, the insulation layer 500 may be coated along a step in the coil patterns 310 and 320 by coating the parylene on the coil patterns 310 ad 320, and thus, the insulation layer 500 may be formed in a uniform thickness. Of course, the insulation layer 500 may also be formed by closely attaching a sheet, which includes one or more materials selected from the group consisting of epoxy, polyimide, and liquid crystalline polymer, onto the coil patterns 310 and 320.

Referring to FIG. 14, a plurality of sheets 100*a* to 100*h* formed of a material including a metal powder 110, a polymer 120, and a heat conducting filler 130 are provided. Here, a metallic material containing iron may be used for the metal powder 110. Epoxy, polyimide, or the like, which may insulate the metal powders 110 from each other may be used for the polymer 120. MgO, AlN, carbon based material, or the like, through which the heat of the metal powder 110 may be dissipated to the outside may be used for the heat conducting filler 130. Also, the surface of the metal powder 110 may be coated with a ferrite material, such as a metal oxide ferrite, or an insulating material such as parylene. Here, the polymer 120 may be included in an amount of approximately 2.0 wt % to approximately 5.0 wt % with respect to 100 wt % of the metal powder, and the heat conducting filler 130 may be included in an amount of approximately 0.5 wt % to approximately 3.0 wt % with respect to 100 wt % of the metal powder. These plurality of sheets 100*a* to 100*h* are respectively disposed over and under the substrate 200 on which the coil patterns 310 and 320 are formed. The plurality of sheets 100*a* to 100*h* may have the content of the heat conducting filler 130 different from each other. For example, in directions upwardly or downwardly away from one surface and the other surface of the substrate 200, the content of the heat conducting filler 130 may progressively increase. That is, the content of the heat conducting filler 130 in the sheets 100*b* and 100*f* positioned over and under the sheets 100*a* and 100*e* contacting the substrate 200 may be greater than that of the heat conducting filler 130 in the sheets 100*a* and 100*e*. Also, the content of the heat conducting filler 130 in sheets 100*c* and 100*g* positioned over and under sheets 100*b* and 100*f* may be greater than that of the heat conducting filler 130 in the sheets 100*b* and 100*f*. In this way, in a direction away from the substrate 200, the content of the heat conducting filler 130 becomes greater, and thus, the efficiency of heat transfer may be improved further. As described in another exemplary embodiment, first and second magnetic layers 610 and 620 may be respectively provided over and under the uppermost and lowermost sheet 100*d* and 100*h*. The first and second magnetic layers 610 and 620 may be manufactured of a material having magnetic permeability greater than the sheets 100*a* to 100*h*. For example, the first and second magnetic layers 610 and 620 may be manufactured by using a ferrite powder and an epoxy resin so as to have magnetic permeability greater than the sheets 100*a* to 100*h*. Also, the heat conducting filler may be allowed to be further included in the first and second magnetic layers 610 and 620.

Referring to FIG. 15, the body 100 is formed such that the plurality of sheets 100*a* to 100*h* are laminated, pressed, and formed with the substrate 200 interposed therebetween. Also, an external electrode 400 may be formed on both end portions of the body 100 such that the external electrode 400 may be electrically connected to extended portions of the coil patterns 310 and 320. The external electrode 400 may be formed such that the body 100 is dipped into a conductive paste or through various methods such as printing, depositing, and sputtering a conductive paste on both end portions of the body 100. Here, a metallic material which may allow the external electrode 400 to have electrical conductivity may be used as the conductive paste. Also, if necessary, a nickel-plated layer and tin-plated layer may further be formed on the surface of the external electrode 400.

Figure 16:
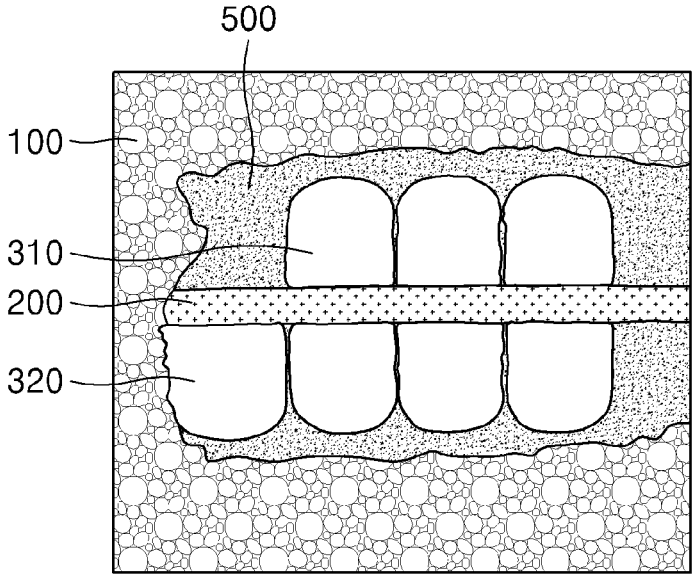
FIGS. 16 and 17 are cross-sectional images of power inductors in accordance with a comparative example and an exemplary embodiment.
Figure 17:
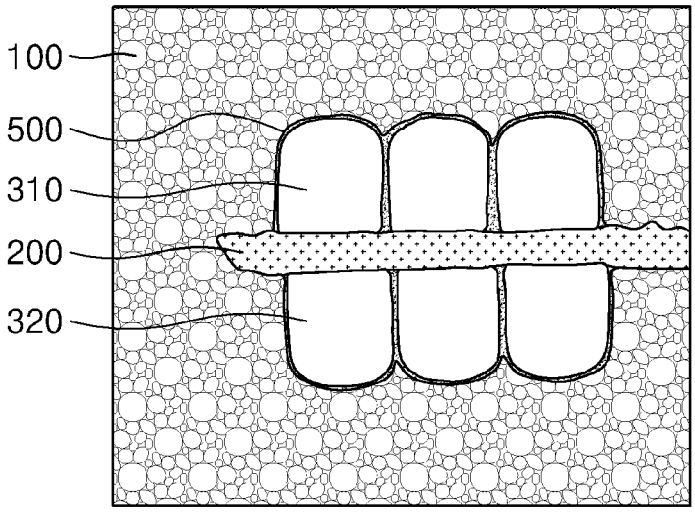

FIG. 16 is a cross-sectional image of a power inductor in which an insulation layer is formed of polyimide in accordance with a comparative example, and FIG. 17 is a cross-sectional image of a power inductor in which an insulation layer is formed of parylene in accordance with an exemplary embodiment. As illustrated in FIG. 17, although parylene is formed in a smaller thickness along the step in the coil patterns 310 and 320, polyimide is formed in a thickness greater than parylene as illustrated in FIG. 16. Also, in order to measure ESD characteristics of the power inductors in accordance with the comparative example and the exemplary embodiment, a voltage of approximately 400 V was repeatedly applied one to ten times, respectively, to power inductors in 20 comparative examples and 20 embodiments. In the case of the comparative example in which the insulation layer was formed of polyimide, 19 out of 20 power inductors were shorted, but in the case of the embodiment in which the insulation layer was formed of parylene, all 20 were not shorted. Also, insulation power voltages were measured, which were approximately 25 V in the comparative examples, and approximately 86 V in the exemplary embodiments. Accordingly, the insulation layer 500, which is formed of parylene for insulating the coil patterns 310 and 320 and the body 100, may be formed with a smaller thickness, and insulation characteristics or the like may be improved.

A power inductor in accordance with exemplary embodiments has a body manufactured of a metal powder, a polymer, and a heat conducting filler. The heat in the body may easily be dissipated to the outside through the inclusion of the heat conducting filler, and thus, the decrease in inductance caused by heating of the body may be prevented.

Also, parylene may be formed in a uniform thickness through coating parylene on a coil pattern, and thus, the insulation between the body and the coil pattern may be improved.

In addition, a decrease in magnetic permeability of the power inductor may also be prevented through manufacturing a substrate provided inside the body and having a coil pattern formed thereon by using a metal ferrite, and the magnetic permeability of the power inductor may be improved through providing at least one magnetic layer to the body.

Also, two or more substrates, each of which has a coil pattern in a coil shape formed on one surface thereof, are provided in the body, so that a plurality of coils may be formed in one body. Thus, the capacity of the power inductor may be increased.

The present invention may, however, be embodied in different forms and should not be construed as limited to the embodiments set forth herein. Rather, the embodiments are provided so that this disclosure will be thorough and complete, and will fully convey the scope of the present invention to those skilled in the art. Further, the present invention is only to be defined by the scopes of the claims.

What is claimed is:

1. A power inductor, comprising:

a body comprising a metal powder;

at least one substrate provided inside the body;

at least one coil pattern provided on at least one surface of the substrate; and an insulation layer formed on the coil pattern for insulation of the coil pattern and the body, wherein the insulation layer is formed of parylene;

wherein the insulation layer is filled between the coil patterns and formed on an upper portion of the coil patterns and a side surface of the coil patterns with a uniform thickness, wherein the insulation layer has a thickness of 3 μm to 100 μm; and wherein the metal powder has a surface coated with a first insulator formed of metal oxide, and a second insulator formed of parylene, wherein the second insulator is coated in a thickness of approximately 1 um to approximately 10 um.

2. The power inductor of claim 1, wherein the metal powder comprises a metal alloy powder containing iron.

3. The power inductor of claim 1, wherein the metal powder has a surface further coated with ferrite material.

4. The power inductor of claim 1, wherein the substrate is formed of a copper clad lamination, or formed such that a copper foil is attached to both surfaces of a metal plate containing iron.

5. The power inductor of claim 1, further comprising an external electrode formed outside the body and connected to the coil pattern.

6. The power inductor of claim 1, wherein the body further comprises a polymer, and a heat conducting filler.

7. The power inductor of claim 6, wherein the heat conducting filler comprises one or more selected from the group consisting of MgO, AlN, and a carbon based material.

8. The power inductor of claim 7, wherein the heat conducting filler is included in an amount of approximately 0.5 wt % to approximately 3 wt % with respect to 100 wt % of the metal powder, and has a size of approximately 0.5 um to approximately 100 um.

9. The power inductor of claim 1, wherein the substrate is provided in at least duplicate or more, and the coil pattern is formed on each of at least two or more substrates.

10. The power inductor of claim 9, further comprising a connection electrode provided outside the body and configured to connect at least two or more coil patterns.

11. The power inductor of claim 10, further comprising at least two or more external electrodes connected to the at least two or more coil patterns, respectively, and formed outside the body.

12. The power inductor of claim 11, wherein the at least two or more external electrodes are formed on a same side surface of the body to be spaced apart from each other, or formed on side surfaces of the body that are different from each other.

13. The power inductor of claim 1, further comprising a magnetic layer provided in at least one region of the body, and having a magnetic permeability greater than that of the body.

14. The power inductor of claim 13, wherein the magnetic layer is formed to comprise a heat conducting filler.

* * * * *